US009796520B2

(12) United States Patent
Ishihara

(10) Patent No.: US 9,796,520 B2
(45) Date of Patent: Oct. 24, 2017

(54) FACIAL MASK SHEET PACKAGE

(71) Applicant: TAIKI CORP., LTD., Osaka-shi, Osaka (JP)

(72) Inventor: Toshio Ishihara, Osaka (JP)

(73) Assignee: Taiki Corp., Ltd., Osaka (JP)

( * ) Notice: Subject to any disclaimer, the term of this patent is extended or adjusted under 35 U.S.C. 154(b) by 0 days.

(21) Appl. No.: 14/768,435

(22) PCT Filed: Feb. 14, 2014

(86) PCT No.: PCT/JP2014/053440
§ 371 (c)(1),
(2) Date: Aug. 17, 2015

(87) PCT Pub. No.: WO2014/129394
PCT Pub. Date: Aug. 28, 2014

(65) Prior Publication Data

US 2016/0060019 A1 Mar. 3, 2016

(30) Foreign Application Priority Data

Feb. 19, 2013 (JP) ..... 2013-030399

(51) Int. Cl.
*B65D 85/62* (2006.01)
*B65D 83/08* (2006.01)
(Continued)

(52) U.S. Cl.
CPC ..... *B65D 83/0805* (2013.01); *A45D 44/002* (2013.01); *B65D 75/5838* (2013.01);
(Continued)

(58) Field of Classification Search
CPC ..... B65D 83/08; B65D 83/0805; B65D 83/0847; B65D 83/0888; B65D 85/16
(Continued)

(56) References Cited

U.S. PATENT DOCUMENTS 4,848,575 A * 7/1989 Nakamura ..... B65D 83/0805 206/449
5,046,640 A * 9/1991 Carroll ..... B65D 51/24 221/213
(Continued)

FOREIGN PATENT DOCUMENTS

JP S60-37329 Y2 11/1985
JP S63-199944 U 12/1988
(Continued)

OTHER PUBLICATIONS

Extended European Search Report, dated Jan. 22, 2016, issued in corresponding European Patent Application No. EP 14 75 3907.
(Continued)

*Primary Examiner* — King M Chu
(74) *Attorney, Agent, or Firm* — Knobbe, Martens Olson & Bear LLP

(57) ABSTRACT

A facial mask sheet package is provided that comprises a perforated tray which has a hole provided at the bottom and in which a stack of Z-folded facial mask sheets wetted with chemical solution is placed, wherein such tray is stored in a pillow bag whose top side has a butt joint formed by sealing the ends of a film, in such a way that the bottom of the tray is positioned on the opposite side of the butt joint.

18 Claims, 12 Drawing Sheets

(51) Int. Cl.
*B65D 75/58* (2006.01)
*A45D 44/00* (2006.01)

(52) U.S. Cl.
CPC ..... *B65D 75/5844* (2013.01); *B65D 75/5894* (2013.01); *B65D 83/0894* (2013.01); *B65D 85/62* (2013.01); *B65D 2575/586* (2013.01)

(58) Field of Classification Search
USPC ..... 206/205, 449, 494
See application file for complete search history.

(56) References Cited

U.S. PATENT DOCUMENTS

| | | | | |
|---|---|---|---|---|
| 6,945,402 | B1 * | 9/2005 | Gueret | B65D 81/3272 206/219 |
| 7,007,801 | B2 * | 3/2006 | Mangold | A47K 10/421 206/494 |
| 7,665,629 | B2 * | 2/2010 | Julius | A47K 10/421 221/302 |
| 2004/0230168 | A1 * | 11/2004 | Keaty, Jr. | A61L 2/0088 604/290 |

FOREIGN PATENT DOCUMENTS

| | | | | |
|---|---|---|---|---|
| JP | H01-267182 | A | 10/1989 | |
| JP | H09-142550 | A | 6/1997 | |
| JP | 2003-012053 | A | 1/2003 | |
| JP | 2003-312757 | A | 11/2003 | |
| JP | 2009-078828 | A | 4/2009 | |
| JP | WO 2010018776 | A1 * | 2/2010 | B65D 77/0433 |
| JP | 2010-285176 | A | 12/2010 | |
| WO | WO 2010/018776 | | 2/2010 | |
| WO | WO 2011/001574 | | 1/2011 | |
| WO | WO 2012/070075 | | 5/2012 | |
| WO | WO 2012/105400 | A1 | 8/2012 | |

OTHER PUBLICATIONS

International Search Report mailed by Japan Patent Office dated May 20, 2014 in the corresponding PCT Application No. PCT/JP2014/053440—11 pages.

* cited by examiner

[Fig. 1a]
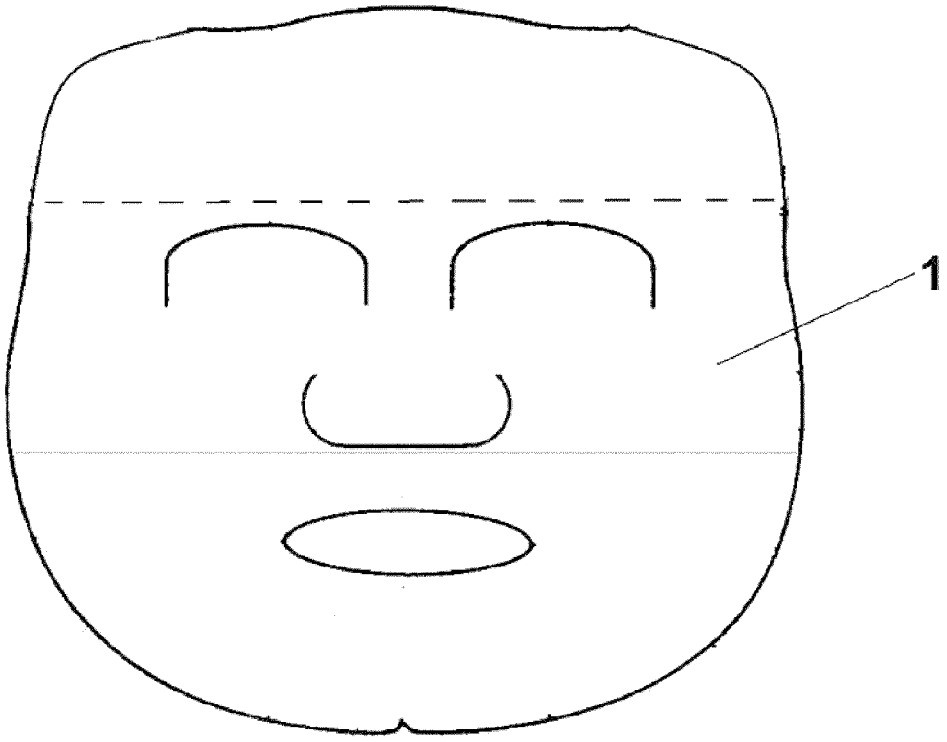

[Fig. 1b]
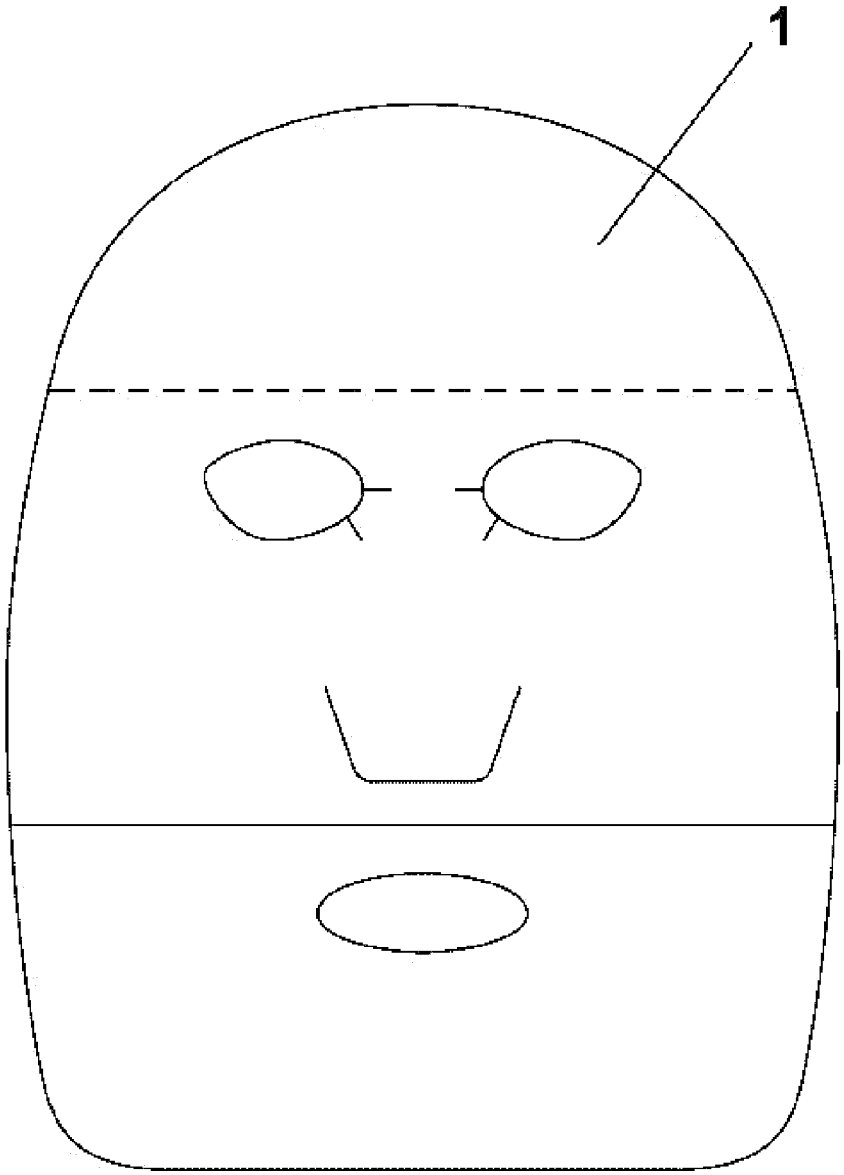

[Fig. 2]
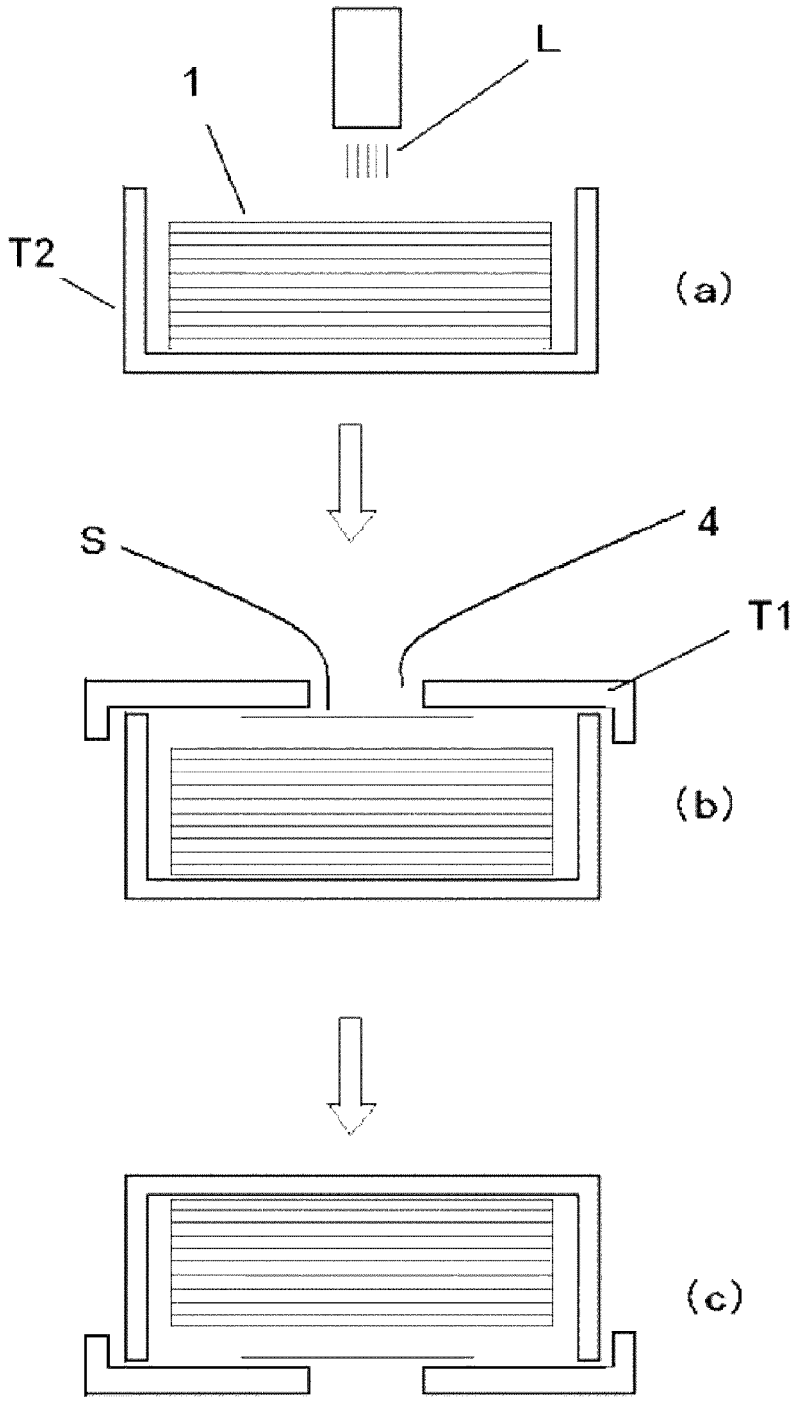

[Fig. 3]
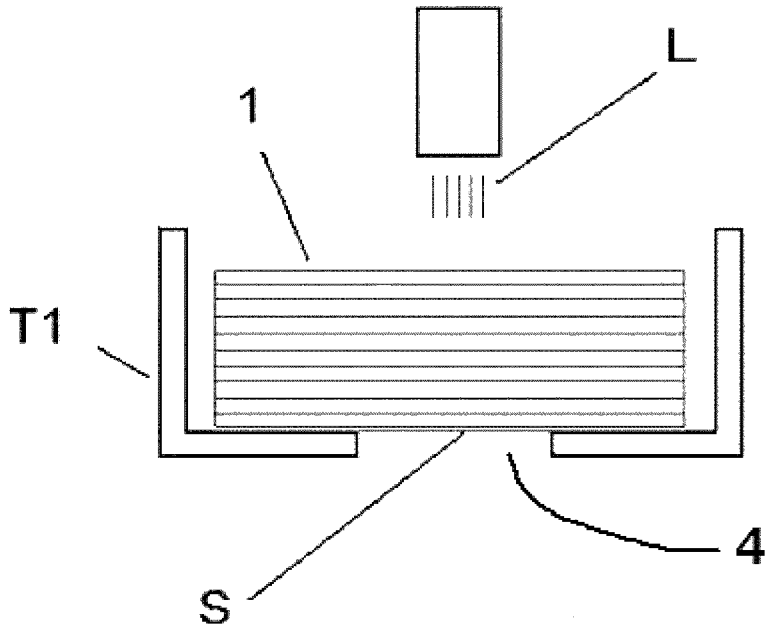

[Fig. 4]
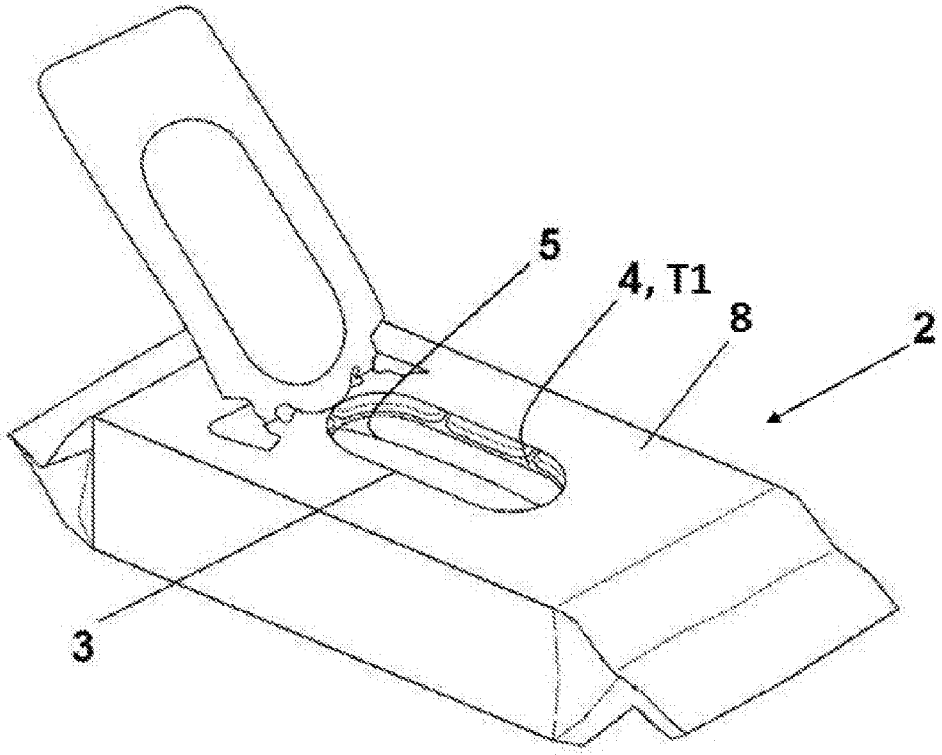

[Fig. 5]
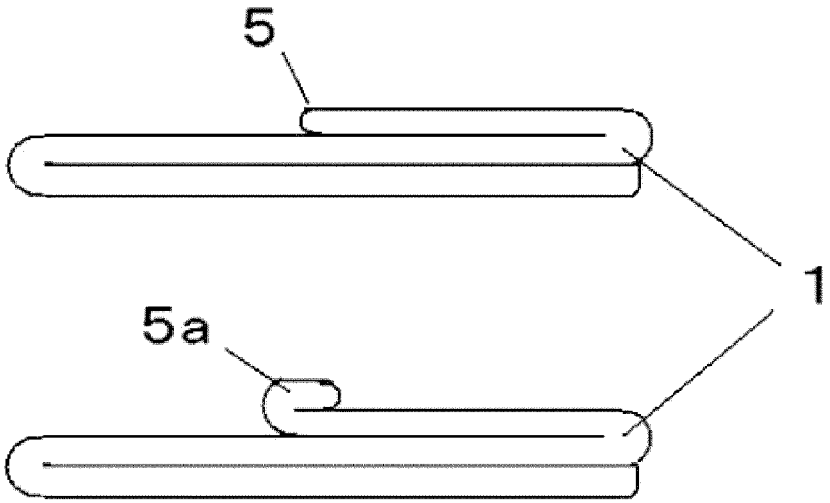
[Fig. 6]
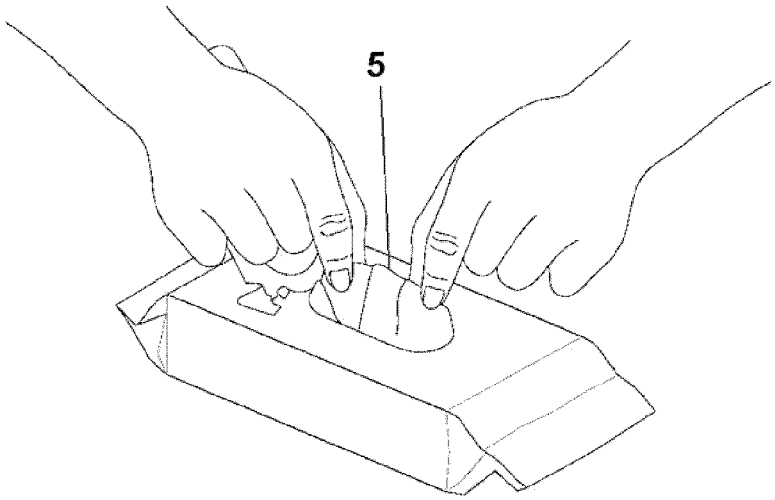

[Fig. 7]
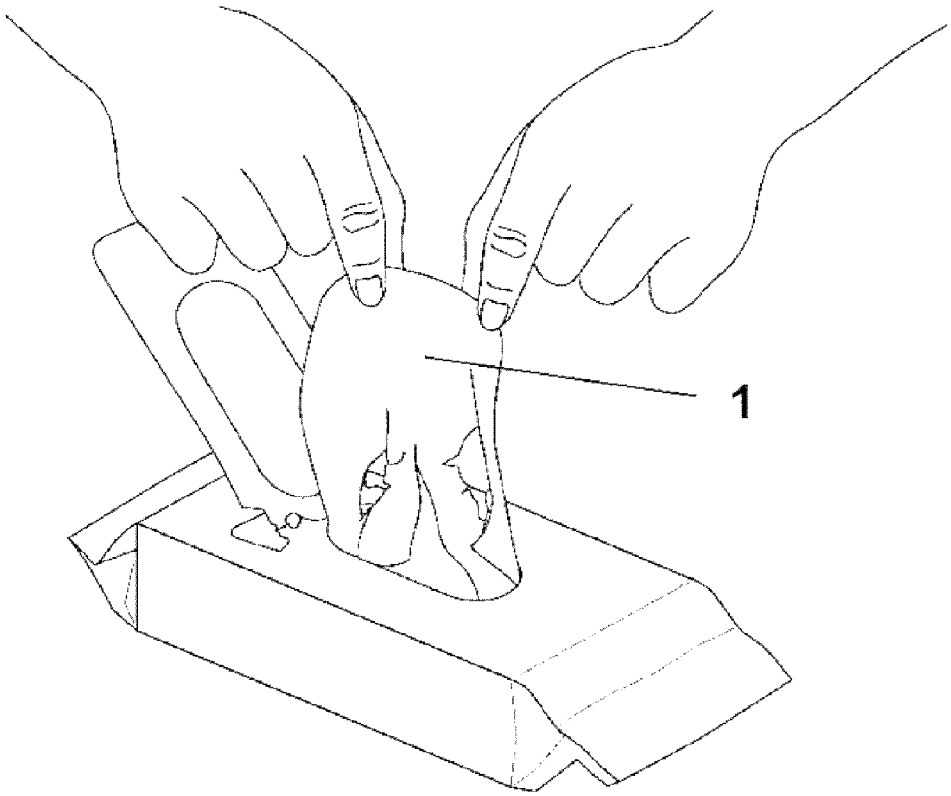

[Fig. 8]
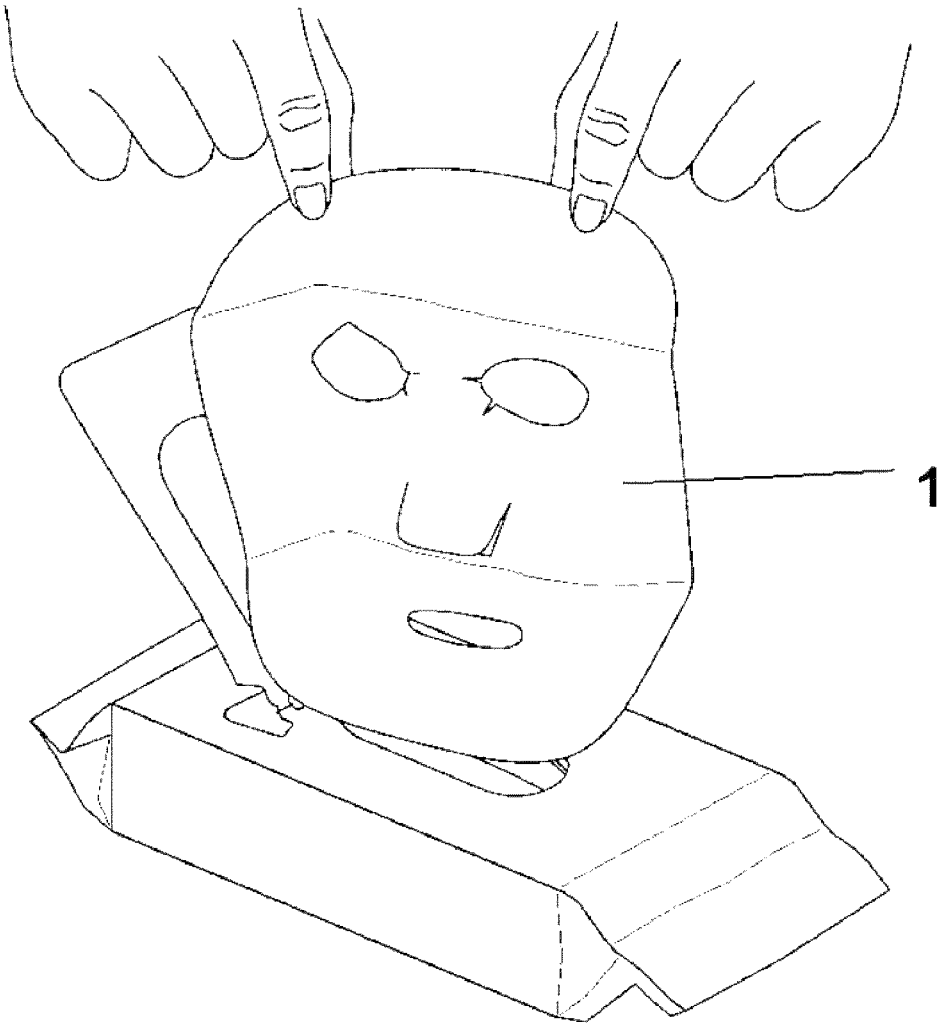

[Fig. 9]
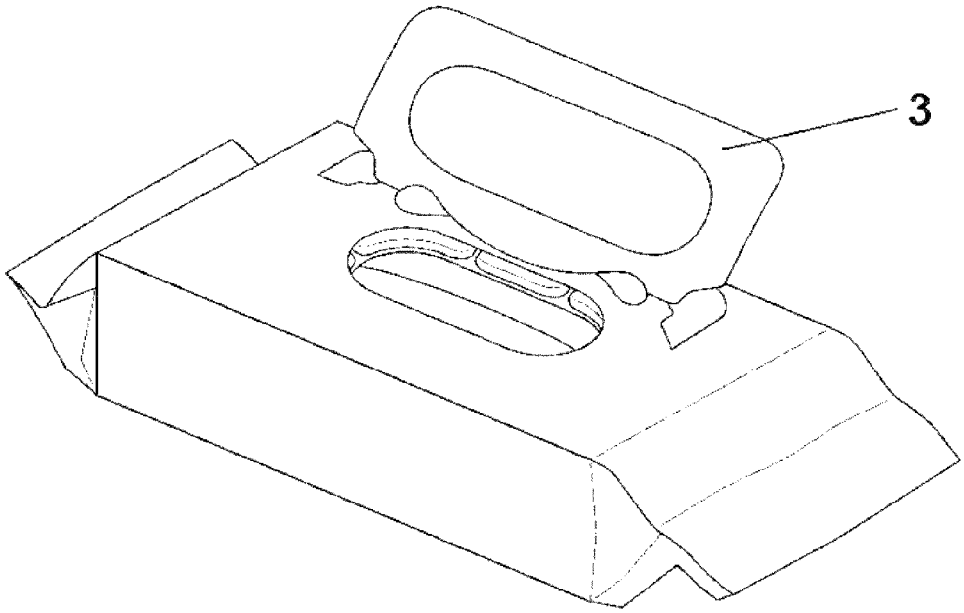
[Fig. 10]
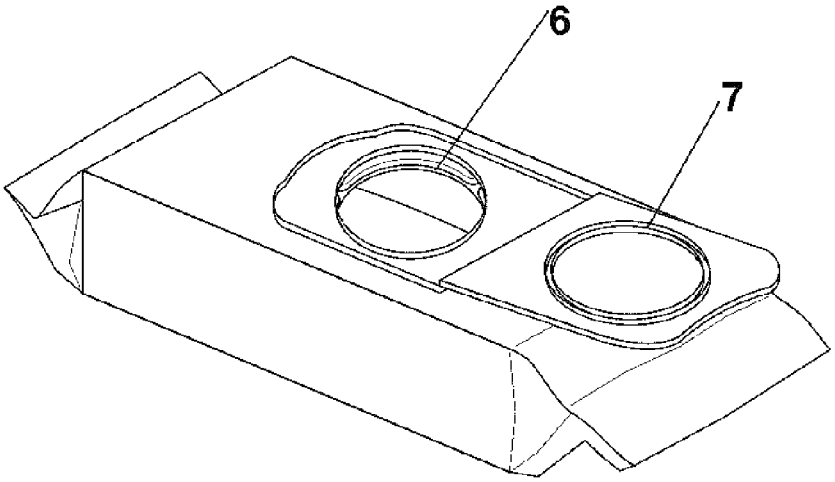

[Fig. 11]
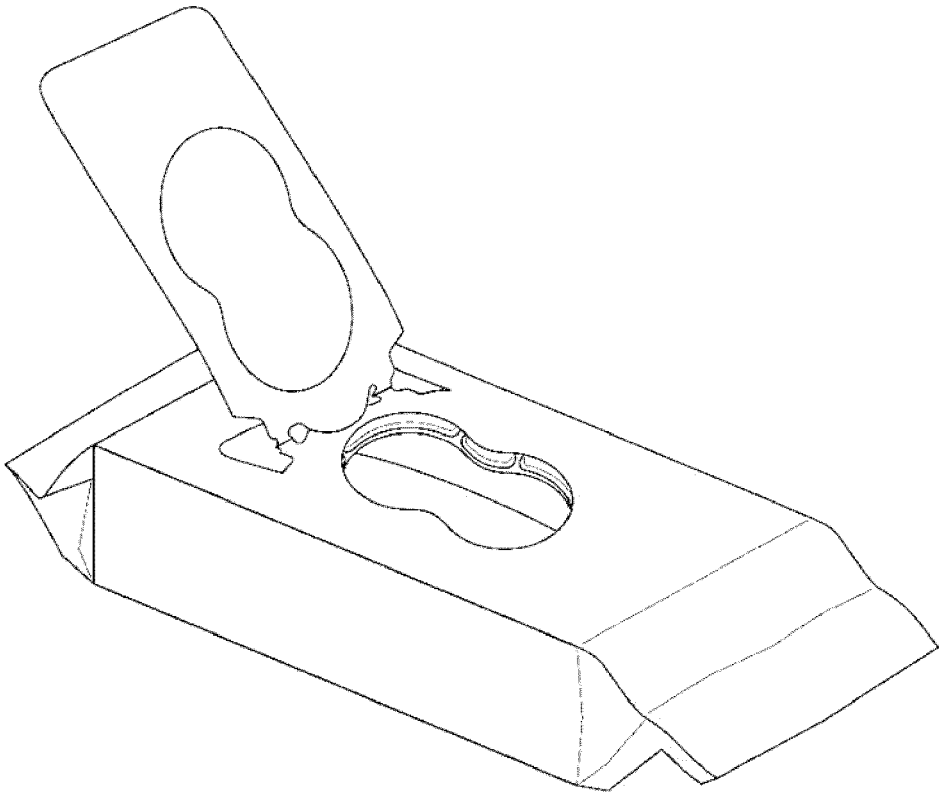

[Fig. 12]
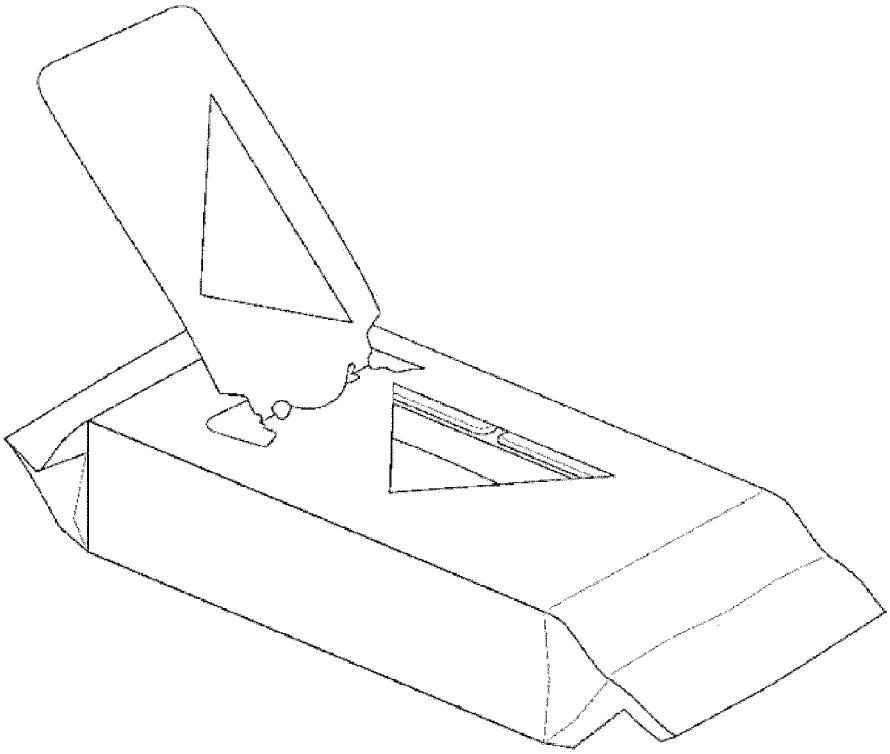

FACIAL MASK SHEET PACKAGE

This application is the U.S. National Phase under 35 U.S.C. §371 of International Application PCT/JP2014/053440, filed Feb. 14, 2014, which claims priority to Japanese Patent Application No. 2013-030399, filed Feb. 19, 2013. The International Application was published under PCT Article 21(2) in a language other than English.

TECHNICAL FIELD

The present invention relates to a facial mask sheet package in which facial mask sheets impregnated with liquid cosmetic preparation, chemical solution, etc., are stored.

BACKGROUND ART

As a way to package a wet sheet or other sheet-shaped material, it is known, for example, to impregnate a wet sheet with cosmetic preparation, chemical solution, etc., and then individually package the wet sheet so that the package will be opened and the wet sheet inside will be taken out and used when necessary. When it comes to using such wet sheets, traditionally multiple individually packaged wet sheets are packed in a single bag and, to use the sheets, the individual packages must be taken out from the bag and opened separately; however, such wet sheets are not easy to use because their package must be opened separately one by one to use the sheet, although the individual packaging prevents growth of bacteria and attachment of contaminants.

In addition, types of wet sheets that are widely used include multiple wet tissues, body wipes or other relatively large wet sheets that are folded and stacked in a pop-up manner and stored in a plastic container or packaged in a pillow bag. Just like tissue papers, some wet sheets are placed in a box or bag and pulled out one by one from the opening provided at the top of the box or in one area of the bag to be used. However, wet sheets must be folded in a special manner to allow for removal from the opening one by one, which makes the manufacturing process complex.

On the other hand, an art of packaging small wet sheets (such as small-sized pads and partial facial masks) individually and then layering and storing them in a sealable container is also widely used.

An example of stacking such multiple small wet sheets in a box or bag is found in Patent Literature 1 where pads impregnated with cosmetic preparation are stacked and stored in a container so that the pads are removed one by one from the opening provided at the top of the container for use, or in Patent Literature 2 that describes a container in which pads impregnated with cosmetic preparation are stacked in such a way that the pads are layered while partially overlapping with each other to allow the overlapping parts to be removed from the lidded opening provided at the top of the container.

Patent Literature 3 describes a flexible material dispensing container characterized in that one plastic sheet is folded to form a molding of roughly W shape in cross section having two exterior walls and two interior walls and the upper sections of the exterior walls are partially cut off to provide a dispensing outlet; however, this container is not sealable and no means are available, either, for sealing the dispensing outlet formed by the cutout.

Means for stacking and storing pads in a container without individually packaging them so that the pads are removed one by one from the outlet at the top of the container, such as the means described in Patent Literatures 1 and 2 above, require that the pads, after removal from the container, must be spread by two hands for use because they are folded in a certain manner.

In addition, the art described in Patent Literature 1 causes the wet sheets to easily stick together, resulting in insufficient operability to separate and remove the wet sheets one by one. To solve this problem, a method of stacking wet sheets by offsetting the positions of adjacent sheets is proposed in Patent Literature 2, but since a large container is required relative to the original area size of the sheet, this method is not desirable in terms of cost and reduction of waste material.

PRIOR ART LITERATURES

Patent Literatures

Patent Literature 1: U.S. Pat. No. 5,046,640

Patent Literature 2: U.S. Pat. No. 7,007,801

Patent Literature 3: Japanese Utility Model Laid-open No. Sho 63-199944

SUMMARY OF THE INVENTION

Problems to Be Solved by the Invention

As described above, with wet sheets, facial mask sheets and other sheets (hereinafter referred to as "facial mask sheets") individually stored in bags, it is not easy to remove the facial mask sheet from the bag, and when the fingers are inserted into the bag, not only the fingertips pinching the sheet, but also other fingers as well as the palms and backs of the hands, get wet by the cosmetic preparation, etc. Accordingly, one object of the present invention is to minimize the wetting of the hands when removing the facial mask sheet from the bag, except for the fingertips pinching the facial mask sheet.

Another object of the present invention is to allow for easy, reliable spreading of the folded facial mask sheet that has been removed from the bag for use, so that the removed facial mask sheet can be attached onto the face, etc., quickly and reliably without wetting the fingers or causing the facial mask sheet to tear or wrinkle.

Means for Solving the Problems

The present invention achieves the aforementioned objects by adopting a specific package in which facial mask sheets are stored, and specifically adopts the means specified below:

1. A facial mask sheet package comprising a perforated tray which has a hole provided at the bottom and in which a stack of Z-folded facial mask sheets wetted with chemical solution is placed, wherein such tray is stored in a pillow bag whose top side has a butt joint formed by sealing the ends of a film, in such a way that the bottom of the tray is positioned on the opposite side of the butt joint.
2. A facial mask sheet package according to 1, wherein the hole is pre-formed and sealed with a liquid-impermeable sheet so that it is opened when the liquid-impermeable sheet is removed.
3. A facial mask sheet package according to 1 or 2, wherein, when the facial mask sheet package is placed with the hole (e.g., 4 in FIG. 13) in the perforated tray (e.g., T1, T2 in FIG. 13) facing up, the Z-folded facial mask sheets (e.g., 1 in FIG. 13) are stacked in such a way that the edge (e.g., 5*b* in FIG. 13) of the bottom side of a facial mask sheet is positioned on top of the edge (e.g., 5*c* in FIG. 13) of the top side of the facial mask sheet under it.

4. A facial mask sheet package according to any one of 1 to 3, wherein, when the facial mask sheet package is placed with the hole (e.g., 4 in FIG. 13) in the perforated tray (e.g., T1, T2 in FIG. 13) facing up, the edge (e.g., 5*c* in FIG. 13) on the top side of the Z-folded facial mask sheet (e.g., 1 in FIG. 13) is positioned at the center of the folded facial mask sheet (e.g., 1 in FIG. 13).
5. A facial mask sheet package according to any one of 1 to 4, wherein a window that can be opened for removal of sheets is formed in the pillow bag film contacting the hole provided in the perforated tray.
6. A facial mask sheet package according to 5, wherein a window outline for forming a window is pre-formed in a thin area of the pillow bag film contacting the hole provided in the perforated tray, and a window is formed whose outline can be torn with an external force along the thin area.
7. A facial mask sheet package according to 5, wherein the window has a lid member that can engage with the rim of the window and seal it in an airtight manner.
8. A facial mask sheet package according to any one of 1 to 7, wherein the perforated tray in which the facial mask sheets are placed is combined with a separate inverted tray.
9. A method of manufacturing the facial mask sheet package in 8, wherein such manufacturing method comprises:
   placing facial mask sheets in a separate tray;
   supplying and impregnating chemical solution to/into the facial mask sheets;
   placing over the separate tray in a manner covering the facial mask sheets a perforated tray having a hole at the bottom which is blocked by a liquid-impermeable sheet; and
   storing in a pillow bag the perforated tray, facial mask sheets and separate tray by inverting or not inverting them together, and then sealing the opening of the pillow bag.

Effects of the Invention

The package storing facial mask sheets as proposed by the present invention is such that facial mask sheets impregnated with cosmetic preparation or other chemical solution are packaged inside, thus preventing the sheets from getting dried up or degrading while in storage before use, and when the facial mask sheets are used, the package can be opened by a specific means so that the sheets can be removed easily from the package without wetting the fingers and hands excessively, and furthermore the removed facial mask sheets can be spread out easily and reliably without wetting the fingers excessively.

Also because the facial mask sheets are placed in the perforated tray and stored in the pillow bag, the perforated tray does not cause the facial mask sheet outlet in the facial mask sheet package to deform when the sheets are used, which makes it easy to remove the sheets. In addition, when the facial mask sheet package is formed by combining the perforated tray in which the facial mask sheets are placed and the separate inverted tray, the shape of the facial mask sheet package reflects the shape of the two combined trays, which results in excellent ease of handling the package during storage, transport, etc., as well as excellent ease of holding the facial mask sheets in hand when used.

BRIEF DESCRIPTION OF THE DRAWINGS

FIG. 1*a* Drawing of a facial mask sheet

FIG. 1*b* Drawing of a facial mask sheet

FIG. 2 Drawing showing an example of steps to place facial mask sheets in a separate tray and supply chemical solution FIG. 3 Drawing showing an example of a step to place facial mask sheets in a perforated tray and supply chemical solution FIG. 4 Drawing of a facial mask sheet package before facial mask sheets are removed FIG. 5 Drawing showing how facial mask sheets are folded FIG. 6 Drawing of a mode in which a facial mask sheet is removed from a facial mask sheet package FIG. 7 Drawing of a mode in which a facial mask sheet is removed from a facial mask sheet package FIG. 8 Drawing of a mode in which a facial mask sheet is removed from a facial mask sheet package FIG. 9 Drawing of a mode of facial mask sheet package FIG. 10 Drawing of a mode of facial mask sheet package FIG. 11 Drawing of a mode of facial mask sheet package FIG. 12 Drawing of a mode of facial mask sheet package FIG. 13 Drawing of a mode of facial mask sheet package, wherein (a) is a schematic view of the facial mask sheet package storing Z-folded facial mask sheets (a pillow bag is omitted), and (b) is an enlarged view of two stacked Z-folded facial mask sheets.

DESCRIPTION OF THE SYMBOLS

Figure 13:
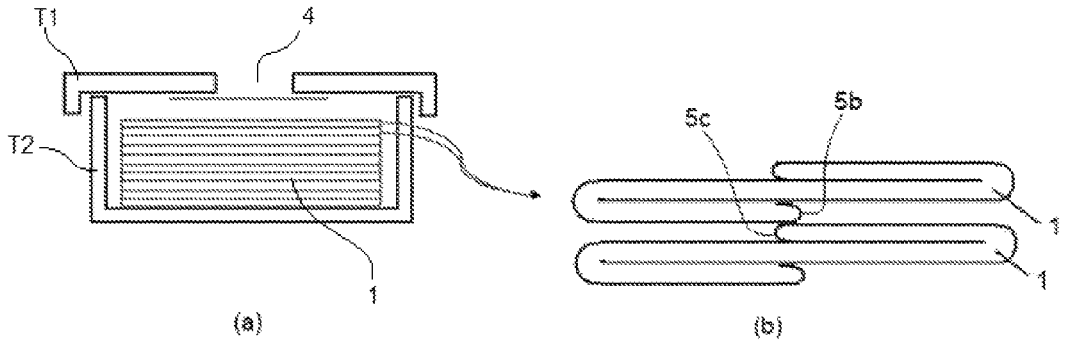

1: Facial mask sheet
2: Facial mask sheet package
3: Window
4: Hole
5: Edge
6: Window outline
7: Lid member
T1: Perforated tray
T2: Separate tray
L: Chemical solution
S: Liquid-impermeable sheet

MODE FOR CARRYING OUT THE INVENTION

The present invention is a package comprising a perforated tray which has a hole provided at the bottom and in which folded facial mask sheets are placed, wherein the perforated tray is stored in a pillow bag having a butt joint on the top side, which package is a facial mask sheet package in which a window is formed that can be opened as needed when removing the sheets, provided on the side of the pillow bag contacting the hole provided in the perforated tray which is opposite the one on which the butt joint is formed.

The present invention is explained based on the drawings.

FIGS. 1*a* and 1*b* each show a facial mask sheet 1 to be placed in a perforated tray which is stored in the facial mask sheet package proposed by the present invention.

The facial mask sheets 1 shown in FIGS. 1*a* and 1*b* are Z-folded. Such Z-folds are formed by, for example, valley-folding the thin line extending laterally below the nose area and then mountain-folding the broken line extending laterally above the eye area.

Needless to say, the folding method of the facial mask sheet 1 is not limited to those shown in FIGS. 1*a* and 1*b*, and any other folding method can be used so long as it forms Z-folds, and the shape of the facial mask sheet 1 is not limited to the shapes in FIGS. 1*a* and 1*b*, either. As explained later, the folding method is not limited in any way, so long as the removed facial mask sheet 1 can be spread out easily.

These Z-folded facial mask sheets 1 are stacked and stored as necessary in a perforated tray whose hole opens at the bottom is pre-sealed by a liquid-impermeable sheet, or in a perforated tray having a hole outline pre-formed in a thin area at the bottom so that a hole could be formed and is actually opened by tearing the hole outline with an external force along the thin area.

It should also be noted that the facial mask sheets need not have the shapes illustrated in FIGS. 1*a* and 1*b*, and they can be those used for other purposes or on parts of the face, and facial mask sheets to be stored in the facial mask sheet package proposed by the present invention are not limited to full-face mask sheets.

The material of the facial mask sheet is not limited in any way, but it must have enough flexibility to permit folding and must not tear or suffer any other damage when the folded ends are pulled.

Such facial mask sheet material is not limited in any way, so long as it constitutes a foldable facial mask sheet, such as paper, resin sheet, metal sheet, woven or non-woven fabric made of organic compound or inorganic compound, or the like.

The base material for facial mask sheets stored in the package under the present invention is a liquid-absorbing sheet, as a rule, where knit, woven or non-woven fabric or any other fiber sheet, paper, foam, etc., can be used. Among foamed sheets, polyurethane foam, NBR foam or other sponge sheet having excellent liquid absorbency and liquid retention property can be used, but from the viewpoints of economy and skin safety, a fiber sheet whose primary constituent is cotton, pulp, rayon or other natural fiber is preferred. For the manufacturing method of such sheet, any known method can be used that employs a knitting machine, resin molding machine, any of various non-woven fabric forming methods, or the like.

In addition to the above, a laminated sheet or other laminate comprising fiber sheet or foamed sheet and resin film can also be used. Preferably the base material is a sheet with thin synthetic resin film laminated on one side, so that the water repellency of the film makes it easier to separate the sheets even when they are wet.

Under the present invention, the facial mask sheet can have any shape such as circle, ellipse, comma shape, polygon, etc., and although a folded facial mask sheet is preferred because the folded parts spread out naturally when the sheet is pinched and lifted up with fingers, the sheet need not be folded.

The chemical solution with which the facial mask sheet is impregnated is a cosmetic preparation or the like, but it is not limited in any way and can be water, skin lotion, cleaning agent, etc., where preferably the facial mask sheet is impregnated with liquid that does not corrode the sheet material and pillow bag.

Under the present invention, any known chemical solution can be impregnated into or attached to the facial mask sheets when they are stored. Such solution can have any property such as liquid, paste, cream or gel, where examples include face wash, skin lotion, skin milk, and other skin care cosmetics, foundation, cheek color and other makeup products, perfume, whitening agent, antioxidant, anti-wrinkling agent, moisturizing agent, sunscreen solution, hair removal agent, antibacterial agent, bactericidal agent, acne treatment agent, and various other types of cosmetics, chemical agent, surface active agent, etc. Under the present invention, cosmetic preparations, chemical agents, cleaning agents, and other chemical solutions in liquid state of varying viscosity, or in semi-liquid state such as cream or gel, can be used in a favorable manner.

The cosmetic preparation, chemical agent, or cleaning agent is retained preferably by 30 to 800 percent by weight, or by 30 to 500 percent by weight, relative to the weight of the base material of facial mask sheet. If the cosmetic preparation, chemical agent, or cleaning agent is liquid, then using it by 30 percent by weight or less does not allow the cosmetic preparation, etc., to be applied efficiently due to small application amount, while using it by more than 800 percent by weight exceeds the liquid retention property of the facial mask sheet and tends to cause any excess liquid applied to drip and collect at the bottom of the storage implement.

For the material film of the pillow bag, any known material may be adopted which can be formed into a pillow bag to store wet facial mask sheets in an airtight manner. Examples of such material include laminate film constituted by multiple resin layers, and laminate film having aluminum or other metal layers, among others.

After these Z-folded facial mask sheets are placed in the perforated tray, skin lotion or other chemical solution is introduced into the perforated tray to impregnate the facial mask sheets, while the perforated tray and facial mask sheets are stored in the pillow bag whose top side has a butt joint formed by sealing the ends of a film, in such a way that the bottom of the tray is positioned on the opposite side of the butt joint, after which the opening of the pillow bag is sealed by means of thermal fusion or any other known means to obtain the facial mask sheet package proposed by the present invention.

FIG. 2(*a*) shows the stage of placing the facial mask sheets in a separate tray T2 before it is stored in the pillow bag constituting the facial mask sheet package proposed by the present invention. The separate tray T2 has no hole 4 at the bottom, and by placing multiple Z-folded facial mask sheets 1 in the separate tray T2 and then supplying skin lotion or other chemical solution L into the separate tray T2 from above, the facial mask sheets in the separate tray T2 are impregnated with the chemical solution. It is also possible to supply the chemical solution L into the separate tray T2 before placing the facial mask sheets in the separate tray T2.

Next, as shown in FIG. 2(*b*), a perforated tray T1 is placed just like closing a lid on the top opening of the separate tray T2. This perforated tray T1 has a hole 4 formed at the bottom. The perforated tray T1 can be simply placed on top of the separate tray T2, or any means for fixing the perforated tray T1 onto the separate tray T2, such as bonding or fusion, can also be adopted.

Here, the hole 4 in the perforated tray T1 is blocked with a liquid-impermeable sheet S. By blocking the hole 4 this way, leakage of the chemical solution into the pillow bag outside the tray can be prevented when the facial mask sheet package is rotated or inverted during storage or distribution.

Thereafter, the separate tray T2, perforated tray T1 and facial mask sheets 1 placed therein are turned upside down, as shown in FIG. 2(*c*), and stored in the pillow bag.

The pillow package thus obtained has the structure of the facial mask sheet package wherein the facial mask sheets 1 placed in the perforated tray T1 are covered by the inverted separate tray T2.

Needless to say, a method in which the separate tray T2 is not used can be adopted, instead of the one in which the separate tray T2 is used for storage, as shown in FIG. 2 above. For example, a hole 4 is formed at the bottom of the perforated tray T1 and the hole 4 is blocked with the liquid-impermeable sheet S beforehand, as shown in FIG. 3. Here, the liquid-impermeable sheet S is used to block the hole 4 of the perforated tray T1 from inside. By placing the multiple Z-folded facial mask sheets 1 in this perforated tray T1 and then supplying the chemical solution L into the perforated tray T1 from above, the chemical solution is impregnated into the facial mask sheets 1 in the perforated tray T1. It is also possible to supply the chemical solution L into the perforated tray T1 before the facial mask sheets 1 are stored in the perforated tray T1. Thereafter, the perforated tray T1 and facial mask sheets 1 placed in it are stored in the pillow bag.

It should be noted that the perforated tray and separate tray used in FIGS. 2 and 3 must be made of resin, metal or other proper material and also have a proper structure so that the shape of the tray is retained and the chemical solution does not permeate through. This way, the facial mask sheet package as a whole will have enough strength needed during storage, transport, and when used.

The facial mask sheet package proposed by the present invention, thus obtained, is used as shown in FIG. 4 and the subsequent figures, for example.

FIG. 4 shows a facial mask sheet package 2 having a window 3 on the side of the pillow bag 8 opposite the butt joint, where the window 3 is opened with fingers, etc., and the hole 4 provided at the bottom of the perforated tray T1 is also open after the sheet, etc., that was sealing it has been removed.

FIG. 5 is a section view of Z-folded facial mask sheets 1. When these Z-folded facial mask sheets 1 are stored in the facial mask sheet package so that their ends 5 are facing up, the end 5 of the topmost Z-folded facial mask sheet is positioned to be seen through the hole 4 provided at the bottom of the perforated tray.

Also in FIG. 5, an edge 5*a* is formed by bending the aforementioned edge 5 one more time. The purpose of this is to more clearly show where to pinch the facial mask sheet 1 with fingers when removing only one facial mask sheet 1 from the facial mask sheet package 2 in which it is stored, and also to create a small ridge from additional folding that would catch the fingertips to provide a guide when pinching the facial mask sheet 1. By providing this edge 5*a*, removing the facial mask sheet 1 becomes easier under the present invention.

It is also possible to color the edges 5, 5*a* so that they can be visually identified in a clear manner.

FIG. 6 shows a condition where the edge 5 of the facial mask sheet 1 pinched with fingers, and the hole at the bottom of the perforated tray, and at least the window provided in the pillow bag, must be large enough to allow the fingers to pinch the edge of the facial mask sheet. Although the facial mask sheet is pinched with a total of four fingers in two hands in FIG. 6, the present invention is not limited to this example, and the edge 5 of the facial mask sheet can be pinched with two fingers in one hand, for example.

FIG. 7 shows the stage of picking up from the facial mask sheet package a facial mask sheet 1 pinched with the fingers. Here, the Z-folded facial mask sheet 1 is spread out as it is lifted upward.

FIG. 8 shows a facial mask sheet 1 that has been pulled up from the facial mask sheet package, where the facial mask sheet 1 is spread out reliably in a fully pulled-up state.

The facial mask sheet 1 that has been pulled up this way is placed over the face with one or two hands, just like a regular facial mask sheet, and since only one facial mask sheet is reliably removed from the facial mask sheet package for use over the face, it will not happen that two or more sheets are accidentally removed from the facial mask sheet package when the original intention was to remove only one sheet.

In addition, sheets can be removed without using the fingers more than necessary, so the facial mask sheet package can be used comfortably.

Now, the Z-folded facial mask sheet 1 stored immediately below the facial mask sheet 1 that has been removed is now present in such a way that its edge faces the window in the pillow bag and the hole provided at the bottom of the perforated tray, and the sheets can be removed one after another in the same manner.

The user can remove the facial mask sheet 1 in the condition shown in FIG. 8 and then directly put it over the face, etc., without performing any extra task such as repositioning the sheet with the fingers.

And, according to this example, the facial mask sheet 1 can be removed and used without having to release the fingers pinching the facial mask sheet 1 or repositioning the sheet with the fingers, which translates to easy, reliable handling of the facial mask sheet 1 from removal from the bag to use, and other fingers, etc., do not get wet.

In FIG. 9, the window 3 in the pillow bag is opened at a 90-degree angle to the direction in which the windows 3 shown in FIGS. 4 and 10 to 12 are open. By setting the direction this way, the window 3 can be held easily when removing the sheet, using the hand removing the facial mask sheet, even when the window has moved in the closing direction.

In the examples shown in FIGS. 4 and 9, the hole provided at the bottom of the perforated tray has a rectangular shape with rounded corners, but any other rectangular shapes such as rectangular shape whose shorter sides are arced can also be used. Needless to say, the shape of the opening provided in the pillow bag can be changed according to such shape of the hole.

The embodiment shown in FIG. 10 is such that the window provided in the pillow bag is circular and a window outline is pre-formed in a thin area so that a window can be formed, where this area is formed using a member that allows the window to be opened by tearing the thin area with an external force and thereby cutting and removing a sealing piece that has been sealing the window outline and window along the thin area.

The facial mask sheet package in FIG. 10 has a lid member 7 provided on it which can engage with a window outline 6 and seal the circular window airtightly in a manner allowing it to open and close. While the facial mask sheet package of the present invention is not in use, the lid member 7 engages with the window outline 6 in an airtight manner to prevent the skin lotion or other chemical solution permeating through the facial mask sheets from evaporating and making it difficult to use the sheets the next time.

As a result, the facial mask sheets are kept in an airtight manner while not in use.

When the facial mask sheets of the present invention are to be used again, the lid member 7 is opened to remove the facial mask sheets using fingers as shown in FIGS. 6 to 8.

Such lid member 7 is formed separately from the pillow bag and attached to the pillow bag by being joined integrally with the attachment part provided on the side of the pillow bag opposite the butt joint side, by fusing, bonding or any other known means.

In the example shown in FIG. 11, the hole provided at the bottom of the perforated tray has a gourd shape. In this case, a pressing force can be applied, when removing the facial mask sheet, by the constricted part in the direction perpendicular to the one in which the facial mask sheet is pulled up, which makes it possible to spread out the Z-folded facial mask sheet in a more reliable manner.

In the example shown in FIG. 12, the hole provided at the bottom of the perforated tray has a triangular shape. In this case, a pressing force can be applied, when removing the facial mask sheet, in the direction perpendicular to the one in which the sheet is pulled up, by pulling up the facial mask sheet in such a way that the sheet remains in contact with the sides of the triangle, which makes it possible to spread out the Z-folded facial mask sheet in a more reliable manner, just like in the example shown in FIG. 11.

What is claimed is:

1. A facial mask sheet package comprising a perforated tray which has a hole provided at a bottom and in which a stack of Z-folded full-face mask sheets wetted with chemical solution is placed, wherein said tray is stored in a pillow bag whose top side has a butt joint formed by sealing ends of a film, in such a way that a bottom of the tray is positioned on an opposite side of the butt joint, said Z-folded full-face mask sheets being stacked in a direction perpendicular to the bottom of the tray, wherein the hole is pre-formed and sealed with a liquid-impermeable sheet so that it is open when the liquid-impermeable sheet is removed.

2. A facial mask sheet package according to claim 1, wherein, when the full-face mask sheet package is placed with the hole in the perforated tray facing up, the Z-folded full-face mask sheets are stacked in such a way that an edge of a bottom side of a full-face mask sheet is positioned on top of an edge of a top side of a full-face mask sheet under it.

3. A facial mask sheet package according to claim 1, wherein, when the full-face mask sheet package is placed with the hole in the perforated tray facing up, an edge on a top side of the Z-folded full-face mask sheet is positioned at a center of the folded full-face mask sheet.

4. A facial mask sheet package according to claim 1, wherein a window that can be opened for removal of the Z-folded full-face mask sheets is formed in the pillow bag film contacting the hole provided in the perforated tray.

5. A facial mask sheet package comprising a perforated tray which has a hole provided at a bottom and in which a stack of Z-folded full-face mask sheets wetted with chemical solution is placed, wherein said tray is stored in a pillow bag whose top side has a butt joint formed by sealing ends of a film, in such a way that a bottom of the tray is positioned on an opposite side of the butt joint, said Z-folded full-face mask sheets being stacked in a direction perpendicular to the bottom of the tray, wherein, when the full-face mask sheet package is placed with the hole in the perforated tray facing up, the Z-folded full-face mask sheets are stacked in such a way that an edge of a bottom side of a full-face mask sheet is positioned on top of an edge of a top side of a full-face mask sheet under it.

6. A facial mask sheet package according to claim 5, wherein, when the full-face mask sheet package is placed with the hole in the perforated tray facing up, an edge on a top side of the Z-folded full-face mask sheet is positioned at a center of the folded full-face mask sheet.

7. A facial mask sheet package according to claim 5, wherein a window that can be opened for removal of the Z-folded full-face mask sheets is formed in the pillow bag film contacting the hole provided in the perforated tray.

8. A facial mask sheet package comprising a perforated tray which has a hole provided at a bottom and in which a stack of Z-folded full-face mask sheets wetted with chemical solution is placed, wherein said tray is stored in a pillow bag whose top side has a butt joint formed by sealing ends of a film, in such a way that a bottom of the tray is positioned on an opposite side of the butt joint, said Z-folded full-face mask sheets being stacked in a direction perpendicular to the bottom of the tray, wherein, when the full-face mask sheet package is placed with the hole in the perforated tray facing up, an edge on a top side of each Z-folded full-face mask sheet is positioned at a center of the Z-folded full-face mask sheet.

9. A facial mask sheet package according to any one of claim 8, wherein a window that can be opened for removal of sheets is formed in the pillow bag film contacting the hole provided in the perforated tray.

10. A facial mask sheet package comprising a perforated tray which has a hole provided at a bottom and in which a stack of Z-folded full-face mask sheets wetted with chemical solution is placed, wherein said tray is stored in a pillow bag whose top side has a butt joint formed by sealing ends of a film, in such a way that a bottom of the tray is positioned on an opposite side of the butt joint, said Z-folded full-face mask sheets being stacked in a direction perpendicular to the bottom of the tray, wherein a window that can be opened for removal of the Z-folded full-face mask sheets is formed in the pillow bag film contacting the hole provided in the perforated tray.

11. A facial mask sheet package according to claim 10, wherein a window outline for forming the window is pre-formed in a thin area of the pillow bag film contacting the hole provided in the perforated tray, and the window is formed whose outline can be torn with an external force along the thin area.

12. A facial mask sheet package according to claim 10, wherein the window has a lid member that can engage with a rim of the window and seal it in an airtight manner.

13. A facial mask sheet package comprising a perforated tray which has a hole provided at a bottom and in which a stack of Z-folded facial mask sheets wetted with chemical solution is placed, wherein said tray is stored in a pillow bag whose top side has a butt joint formed by sealing ends of a film, in such a way that a bottom of the tray is positioned on an opposite side of the butt joint, wherein the perforated tray in which the facial mask sheets are placed is combined with a separate inverted tray.

14. A facial mask sheet package according to claim 13, wherein the hole is pre-formed and sealed with a liquid-impermeable sheet so that it is open when the liquid-impermeable sheet is removed.

15. A facial mask sheet package according to claim 13, wherein when the facial mask sheet package is placed with the hole in the perforated tray facing up, the Z-folded facial mask sheets are stacked in such a way that an edge of a bottom side of a facial mask sheet is positioned on top of an edge of a top side of a facial mask sheet under it.

16. A facial mask sheet package according to claim 13, wherein when the facial mask sheet package is placed with the hole in the perforated tray facing up, an edge on a top side of each Z-folded facial mask sheet is positioned at a center of the Z-folded facial mask sheet.

17. A facial mask sheet package according to claim 13, wherein a window that can be opened for removal of the Z-folded facial mask sheets is formed in the pillow bag film contacting the hole provided in the perforated tray.

18. A facial mask sheet package according to claim 13, wherein a window outline for forming the window is pre-formed in a thin area of the pillow bag film contacting the hole provided in the perforated tray, and the window is formed whose outline can be torn with an external force along the thin area.

* * * * *